United States Patent [19]

Bähre et al.

[11] 4,063,782

[45] Dec. 20, 1977

[54] LONG WALL MINING APPARATUS GUIDE STRUCTURE

[75] Inventors: Karl Bähre, Gladbeck; Reinhold Krohm, Herne, both of Germany

[73] Assignee: Klockner-Werke AG, Duisburg, Germany

[21] Appl. No.: 737,086

[22] Filed: Oct. 29, 1976

[30] Foreign Application Priority Data

Nov. 20, 1975 Germany ..... 2552029

[51] Int. Cl.[2] ..... E21C 35/12

[52] U.S. Cl. ..... 299/34; 299/43

[58] Field of Search ..... 299/32, 34, 43

[56] References Cited

U.S. PATENT DOCUMENTS

| | | | |
|---|---|---|---|
| 3,164,412 | 1/1965 | Hauschopp et al. | 299/34 |
| 3,897,108 | 7/1975 | Krohm et al. | 299/34 |

*Primary Examiner*—Ernest R. Purser

*Attorney, Agent, or Firm*—Michael J. Striker

[57] ABSTRACT

An elongated conveyor is adapted to extend along a mine face in an underground mine gallery. A mining machine, such as a coal planer or the like is reciprocably arranged in the space between the mine face and the conveyor and has a bottom plate sliding on the sole of the mine gallery and extending below and with an end portion thereof beyond the conveyor. An endless chain having an upper and a lower run is used to reciprocate the mining machine along the mine face. Chain guide means are connected to the side of the conveyor facing away from the mine face and comprise superimposed substantially cylindrical guide channels for respectively guiding the upper and the lower run of the endless chain. To improve the guiding of the mining machine, an elongated cylindrical guide member is provided fixedly connected to the end portion of the bottom plate thereof, and this elongated guide member is either slidably guided in the lower one of the superimposed guide channels and forms part of the lower run of the endless chain, or the elongated guide member is guided in a separate guide channel arranged between the conveyor and the chain guide means while the free end of the bottom plate is connected to the lower run of the chain.

19 Claims, 3 Drawing Figures

LONG WALL MINING APPARATUS GUIDE STRUCTURE

BACKGROUND OF THE INVENTION:

The present invention relates to an arrangement for guiding a mining machine, for instance a coal planer or the like in an underground mine gallery along a conveyor in which the bottom plate of the mining machine extends below the conveyor and is guided by means of an elongated cylindrical guide member, extending in the direction of the conveyor, fixedly attached to the end portion of the bottom plate and arranged in a guide channel parallel to the conveyor, while the mining machine is reciprocated along the conveyor by means of an endless chain having an upper and a lower run, which are respectively guided in chain guide means connected to the side of the conveyor opposite the mine face and having two separated superimposed channels for respectively guiding the upper and the lower run of the endless chain.

In all known machine guide means arranged on the side of the conveyor opposite the mine face, the lower chain guide channel serves also for guiding the mining machine and is therefore subjected to multiple stresses since the flexible chain and the rigid cylindrical guide member which is connected to the bottom plate of the mining machine will exert essentialy different stresses onto the chain guide. Since the conveyor, during the movement thereof towards the mine face and due to the shape of the sole of the mine gallery, is deviated at the ends of the successive conveyor sections in horizontal and vertical direction, the elongated cylindrical guide member which is fixedly connected to the bottom plate will be twisted through the guide channel and create wedging forces which will lead to an enlargement of the guide slots in the guide channel. In the known constructions the cylindrical guide member is connected to the bottom plate in such a manner that the guide member will also be subjected to a vertical moment which must be taken up by the lower guide channel for the chain. This will result to a considerable wear of the cooperating elements which will reduce the useful life of the mining machine guide. Furthermore, in the known constructions, the guide channels have usually rectangular cross-sections, which will lead to an accumulation of coal dust within the guide channels, with the resulting increase of the wear thereof.

SUMMARY OF THE INVENTION:

It is an object of the present invention to provide, in a long wall mining apparatus, a guide of the aforementioned kind for the mining machine of the apparatus, which avoids the disadvantages of such guides known in the art, in which the chain for reciprocating the mining machine is exactly guided and in which the forces and moments acting between the guide member connected to the bottom plate of the mining machine and the guide thereof are distributed in a highly advantageous manner.

It is a further object of the invention to provide an apparatus of the aforementioned kind, in which the components thereof are subjected to less wear than in known apparatus of this kind.

With these and other objects in view, which will become apparent as the description proceeds, the long wall mining apparatus according to the present invention mainly comprises an elongated conveyor adapted to extend along a mine face of an underground mine gallery, a mining machine such as a coal planer or the like reciprocatable along the conveyor between the latter and the mine face and having a bottom plate adapted to slide on the sole of the mine gallery and extending below and beyond the conveyor to the side of the latter opposite the mine face, guide means for guiding the mining machine along the conveyor and comprising an elongated cylindrical guide member extending in the direction of the conveyor and being fixedly attached to the end portion of the bottom plate, a guide channel parallel to the conveyor slidingly housing the guide member, and means operatively connected to the bottom plate for reciprocating the mining machine along the conveyor. These means preferably comprise endless chain means having an upper and a lower run and chain guide means connected to the side of the conveyor opposite the mine face and forming two separated, superimposed channels for respectively guiding the upper and the lower run of the endless chain. According to one embodiment of the present invention, the elongated guide member is reciprocatably arranged in the lower one of the two superimposed channels, fixedly connected to the end portion of the bottom plate and interconnected between the links of the lower run, whereas the upper of the two separated channels serves to guide the upper run of the endless chain.

According to another embodiment of the present invention the endless chain is likewise guided in superimposed separated channels extending parallel to the conveyor on the side thereof facing away from the mine face, with the end portion of the bottom plate of the mining machine connected to the lower run of the chain, while the elongated guide member, which is fixedly connected to the end portion of the bottom plate, is guided in a separate channel extending parallel to the conveyor and arranged between the latter and the guide channel for the lower run of the chain.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

Figure 1:
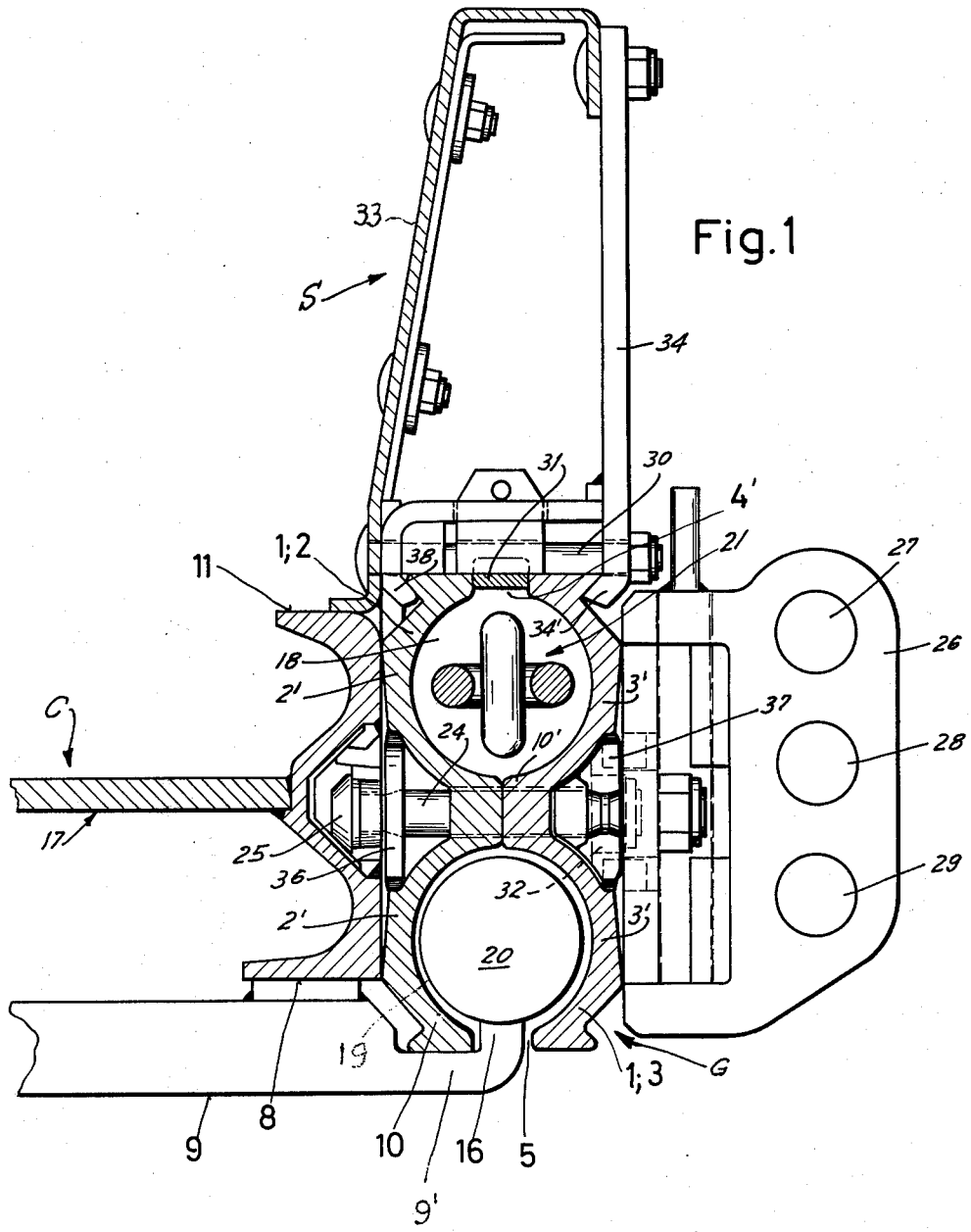
FIG. 1 is a vertical cross-section through a first embodiment of a partially illustrated long wall mining apparatus according to the present invention.

DESCRIPTION OF THE PREFERRED EMBODIMENTS:

Referring now to the drawing and more specifically to FIG. 1 of the same, it will be seen that the apparatus according to the present invention comprises an elongated conveyor C, which is composed of a plurality of longitudinally arranged conveyor sections that are connected with one another so that the conveyor sections may be inclined somewhat with reference to one another, both in vertical and in horizontal directions, to accommodate themselves to an uneven bottom face of an underground mine gallery, as well as to the contour of the mine face thereof. Such conveyors are well known in the art and for instance shown in U.S. Pat. No. 3,625,567. Each conveyor section of this type is essentially composed of two profiled side walls 11, of which only the right side wall is shown in FIG. 1, but it is to be understood that each conveyor section comprises also an opposite mirror-symmetrical side wall 11, which is connected to the side wall 11 shown, by a transverse plate 17. Such conveyors are frequently constructed as scraper conveyors having chains, which are guided in the internal profiles of the side walls 11, and scraper elements which in the upper run of the conveyor are dragged over the upper surface of the transverse wall 17 to move coal along the latter.

A mining machine, such as a coal planer or coal plough, is reciprocably arranged on the left side of the conveyor C, which faces the non-illustrated mine face. Such coal planers or coal ploughs are well known in the art and for instance disclosed in the copending application Ser. No. 670,173 (Bähre et al.) and only the bottom plate 9 of this coat plough is illustrated in the drawing. The coal plough has cutting members, not shown in the drawing, to engage the mine face and to remove coal therefrom, when the coal plough is reciprocated along the mine face lengthwise of the conveyor C. The bottom plate 9 of the coal plough, shown in the drawing, Extends beneath the conveyor C and with an end portion 9' thereof beyond the right side of the conveyor facing away from the mine face. Guide means G are arranged at the right side of the conveyor C facing away from the mine face. These guide means comprise two mirror-symmetrically arranged guide halves 2 and 3 in the form of rolled profiles 1. Each of the guide halves 2 and 3 comprises two bow-shaped legs 10 which are interconnected to each other by a central portion 10', abutting with a flat vertical face against the central portion of the other half so as to form two parallelly extending superimposed guide channels 18 and 19 of substantially cylindrical cross-section for guiding the upper and the lower run of an endless chain 21. In the embodiment shown in FIG. 1 the guide means include further an elongated cylindrical guide member 20, extending in longitudinal direction parallel to the longitudinal direction of the conveyor C, and being slidingly arranged in the lower guide channel 19. The elongated guide member 20, which is interconnected with the links of the chain 21 in the lower guide channel 19, is fixedly connected by a hook-shaped portion 16 to the extension 9' of the bottom plate 9 of the coal plough. The two halves 2 and 3 of the guide are interconnected to each other by screw bolts 24, extending through appropriate bores in the central portions 19', and members 36 and 37 arranged on the bolts 24. The members 36 and 37 are respectively welded to the corners of outwardly projecting portions 2' and 3' of the guide halves 2 and 3. The outer free ends of the bow-shaped legs 10 of the two guide halves 2 and 3 are separated from each other to form respectively elongated slots 4 and 5, and the hook-shaped portion 16 of the bottom plate 9 extends upwardly through the lower slot 5. The head 25 of the screw bolt 24 is located in an appropriate cutout of the right side wall 11 of the conveyor C. The free end portions of the bow-shaped legs 10 are formed at the outer surfaces thereof with grooves, so that the free end portions of the two profiles 2 and 3 form together a dove-tailed guide. The lower legs of the two profiles 2 and 3 extend beyond the bottom face 8 of the side wall 11 of the conveyor and the lower end of the leg 10 of the profile 2 slidingly engages an upper face of the end portion 9' of the bottom plate 9.

The arrangement includes further a super-structure S arranged above the guide G. The super-structure S comprises a front plate 33 having an upper rearwardly and downwardly extending portion to which a plurality of vertical braces 34 are connected by screws or the like. Additional screw bolts 30 extend through bores in the lower end portion of the front plate 33 and lower portions of the upright support members 34 to press thereby a member 38, as well as inwardly bent end portions 34' of the support members 34, into the grooves at the upper ends of the bow-shaped legs of the two guide halves 2 and 3. The upper slot 4 is bridged by an elongated strip 31 having outer edge faces which are pressed against the corresponding faces of the profiled members 2 and 3 forming the upper slot 4. The arrangement shown in FIG. 1 includes further a member 26, extending with portions thereof into keyhole-shaped openings 32 provided in the right guide half 3, as viewed in FIG. 1, and this member 26 is formed with three superimposed channels 27, 28 and 29 therethrough for connecting advancing means of well known construction, not shown in the drawing, for advancing the guide means G, the conveyor C and the mining machine toward the mine face.

Due to the abutting central portions 10' of the two profiles 2 and 3, the two guide channels 18 and 19 are completely separated from each other and an extremely rigid construction is derived in this way. The useful life of the guide member 20 and the endless chain 21 is further increased by the separation of the two guide channels 18 and 19 and by the guide slots 4 and 5 assuring a division of the vertical force components, whereby the endless chain 21, due to the substantially cylindrical form of the guide channels 18 and 19, are centrally guided in the guide channels. The useful life of the arrangement is further improved, in that the two profiled halves 2 and 3 may be turned about the horizontal axis after the lower guide channel 19, in which the elongated guide member 20 is arranged, is excessively worn.

Due to the substantially cylindrical form of the guide channels 18 nd 19, accumulation of coal dust in these channels is prevented, since the elements passing through these channels will continuously clean the latter to thus avoid excessive friction of the elements moving through the guide channels with the inner surfaces of the latter, which in turn will reduce the necessary force for reciprocating these elements.

Figure 3:
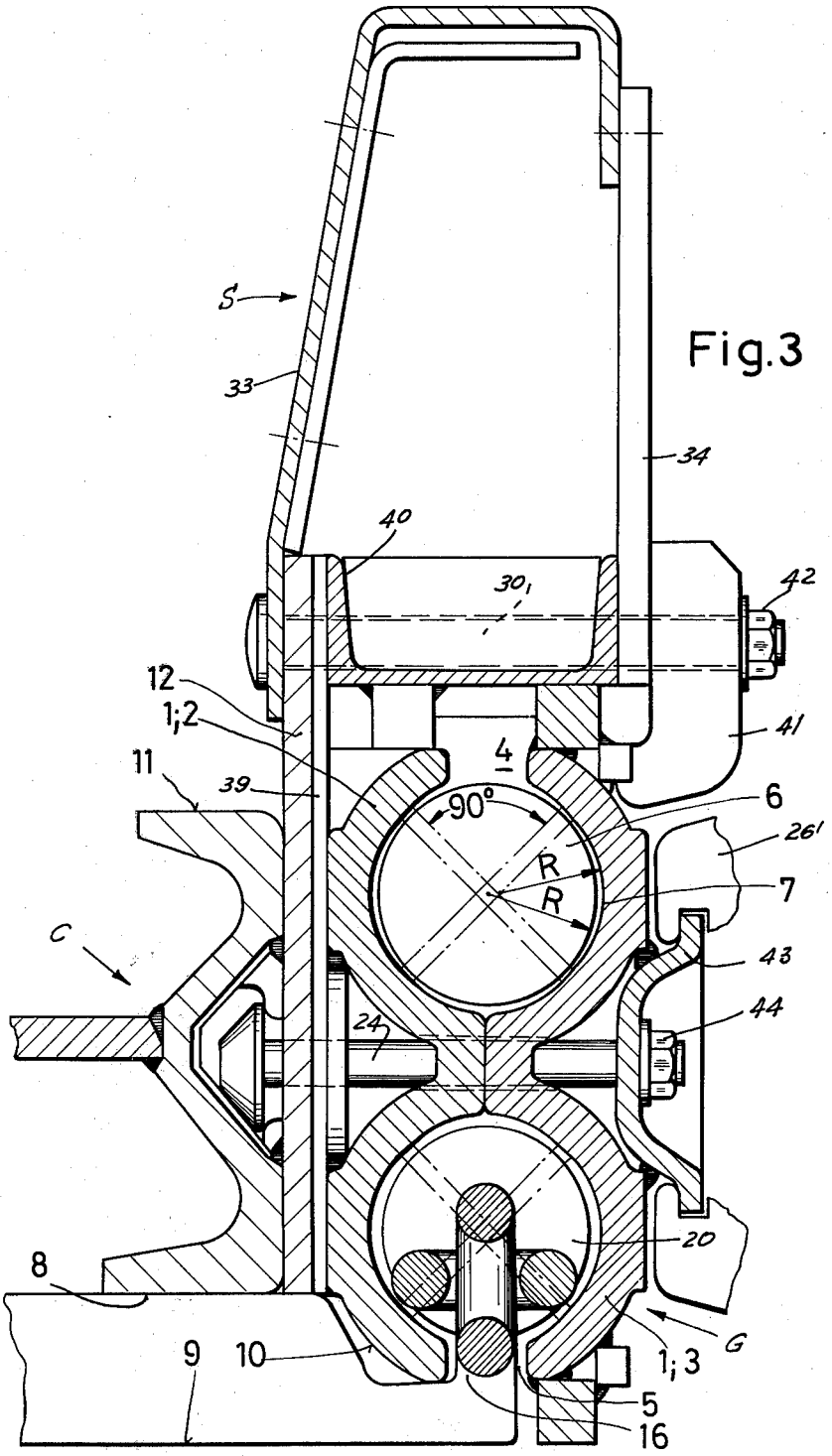
FIG. 3 is a similar cross-section through a third embodiment.

The useful life of the mining machine guide member 20 and the chain 21 can be further extended when the chain 21 is provided with a plurality of cylindrical guide discs 6, interposed, spaced from each other, between the chain links, as especially shown in FIG. 3, and if the cross-section of each guide channel is formed by four circular arcs of the same radii R, equal to the radii of the discs 6, and having their centers offset from the center of the respective channel to opposite sides of vertical and horizontal axes passing through the center of the channel, so that the guide discs may abut along a portion 7 through an angle of 90° against the inner surfaces of the guide channels, thereby reducing the specific surface pressure between the guide discs 6 and the inner surfaces of the channels.

The useful life of the arrangement is further improved, in that the forces imparted by the member 26 to the guide half 3 are transmitted by the central portion 10' thereof to the corresponding central portion 10' of the guide half 2 and from the latter in divided form by means of the projections 2' onto the upper and lower portions of the side wall 11 of the conveyor C, so that a change in the width of the lower guide slot 5 is positively avoided.

In the embodiment shown in FIG. 3, the useful life of the arrangement is further improved by providing a protecting plate 12 between the right side wall 11 of the conveyor C and the left half 2 of the guide G. A plurality of flat upright metal strips 39 are preferably welded to the right side of the protecting plate 12 to reinforce the latter and to provide a gap between the protecting plate 12 and the adjacent profiled member 2 to facilitate the connection of successive guide sections to each other.

The plate 12 extends with an upper portion beyond the upper end of the guide G and this upper portion is again connected to the super-structure S by a plurality of screw bolts 30. In this construction a structural channel 40 is arranged between the upper ends of the strips 39 and the support members or braces 34, while a plurality of clamping members 41 pressed by the nuts 42 on the screw bolts 30 connect the support members 34, in the manner as shown, to the profiled member 3. The right ends of the central screw bolts 24 extend through appropriate bores in cup-shaped members 43 welded at portions thereof to the profiled member 3 and held on the screw bolts 24 by the nuts 44. The members 43 serve to connect advancing means 26', only partially shown in FIG. 3, to the arrangement. The plate 12 serves to distribute the forces imparted to the guide by the advancing means 26' over portions of the right side wall 11 of the conveyor C and the super-structure S.

Figure 2:
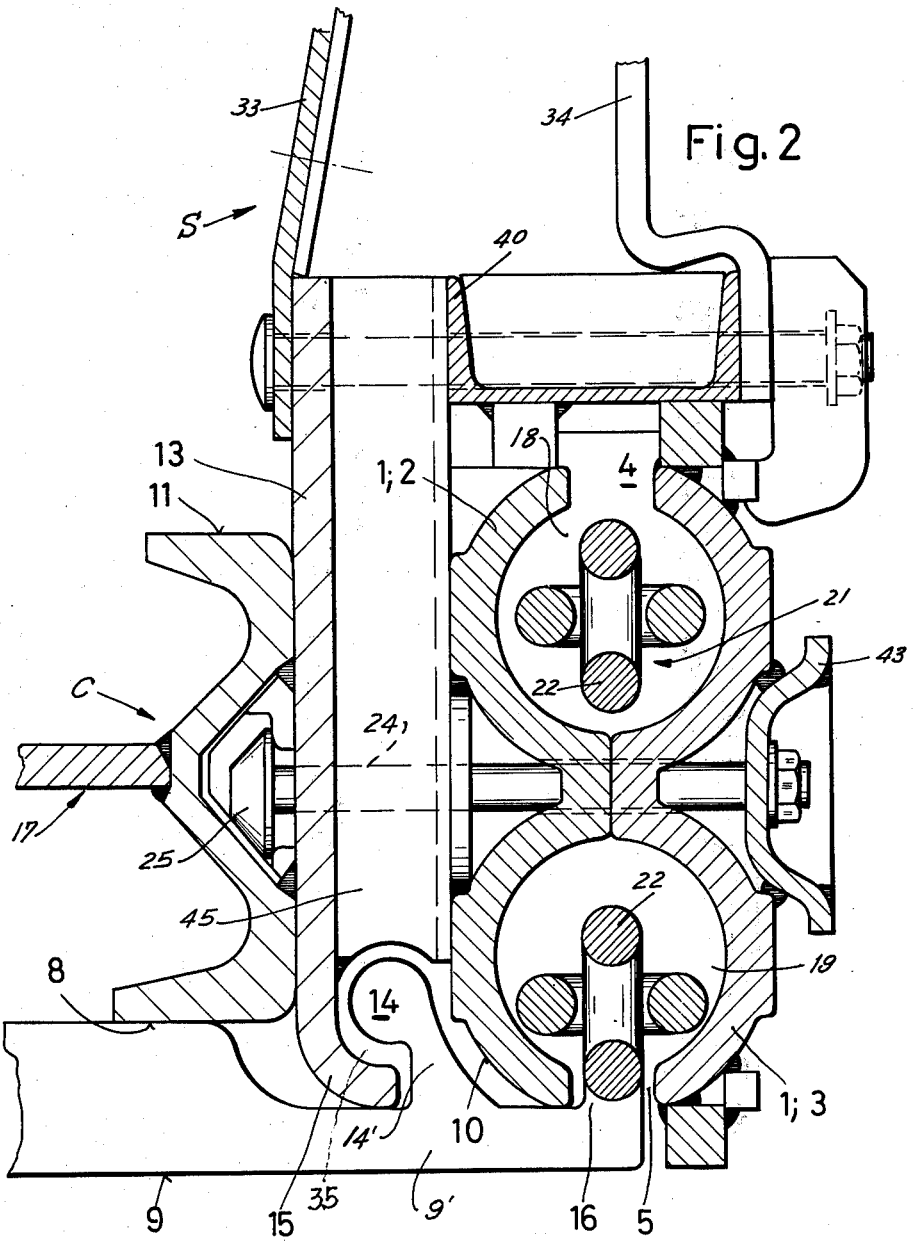
FIG. 2 is a similar cross-section through a second embodiment.

The embodiment shown in FIG. 2 essentially differs from the embodiments shown in FIGS. 1 and 3, in that a separate guide channel 35 is provided for the elongated substantially cylindrical guide member 14, which is fixedly connected to the bottom plate 9 of the mining machine. This guide channel 35 is formed by an inwardly turned bottom end 15 of a plate 13, which is welded to the right side wall 11 of the conveyor C. The elongated guide member 14 is substantially cylindrical and has opposite rounded ends so as to be substantially torpedo-shaped. The torpedo-shaped guide member 14 slides on the bent end 15 of the plate 13, which thus absorbs vertical and horizontal forces transmitted to the guide member. The transmission of forces from the chain 21 to the bottom plate is carried out by the hook-shaped portion 16, fixed to the free end of the bottom plate, which serves in this embodiment only as coupling between the bottom plate and the chain and which floats in the lower guide channel 19. This will assure an increased life of the arrangement, due to the reduction of wear in the chain guide. It is to be understood that the embodiment shown in FIG. 2 includes also advancing means 26', as shown in FIG. 3, which are connected to the cup-shaped members 43. Any force transmitted to the arrangement by the advancing means, not shown in FIG. 2, is in part received by the bent end 15 of the plate 13, which reduces any wear on the profiled member 2, while the plate 13, which is of simple construction, can be replaced after excessive wear of its lower bent portion 15 without must expenditure. The upper part of the guide channel 35 is covered by a sheet metal member 45, the upper end of which is sandwiched between the upper portion of the plate 13 and the structural channel 40, which is connected to the super-structure S, partly shown in FIG. 2, in the same manner as described in connection with FIG. 3.

The torpedo-shaped guide member 14 is in longitudinal direction constructed in such a manner that, when a pulling force acts on the hook-shaped portion 16, the guide member 14 will abut with its whole length against the inwardly bent end 15 of the plate 13, thereby improving the guide of the bottom plate 9 of the mining machine, and resulting in a reduced force to reciprocate the later along the mine face.

The height of the portion 14' which connects the guide member 14 to the end portion 9' of the bottom plate is dimensioned in such a manner that the lower portions of the vertical links 22 of the lower run of the endless chain 21 in the guide channel 19 are located in the guide slot 5 between the free ends of the lower legs 10 of the two profiled members 2 and 3. This will result in an improved guiding of the lower run of the chain and a concomitant reduction of the force for driving the same.

In all embodiments shown the upper face of the bottom plate 9 slides on the bottom face 8 of the side walls 11 of the conveyor.

It will be understood that each of the elements described above, or two or more together, may also find a useful application in other types of long wall mining apparatus differing from the types described above.

While the invention has been illustrated and described as embodied in a long wall mining apparatus, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a long wall mining apparatus, a combination comprising an elongated conveyor adapted to extend along a mine face of an underground mine gallery; a mining machine, such as a coal planer or the like reciprocatable along said conveyor between the latter and the mine face and having a bottom plate extending with an end portion thereof below and beyond said conveyor, said bottom plate having a bottom face adapted to slide on the floor of the mine gallery; guide means for guiding said mining machine along said conveyor and comprising an elongated cylindrical guide member extending in the direction of the conveyor fixedly attached to said end portion of said bottom plate and a guide channel parallel to said conveyor slidingly housing said guide member; and means operatively connected to said bottom plate for reciprocating said mining machine along said conveyor and comprising endless chain means having an upper and a lower run and chain guide means connected to the side of the conveyor opposite said mine face and forming two separate superimposed channels for respectively guiding said upper and said lower run of said endless chain means, said superimposed channels being formed by two mirror-symmetrically arranged identical profiled members.

2. A combination as defined in claim 1, wherein superimposed channels have substantially cylindrical cross-sections.

3. A combination as defined in claim 1, wherein superimposed chain means comprise substantially horizontal and substantially vertical chain links alternating with each other, and wherein said channels are provided with guide slots for guiding at least some of the vertical chain links.

4. A combination as defined in claim 1, wherein said elongated guide member is interconnected between links of said lower run and wherein said guide channel slidingly housing said guide member is constituted by the lower run of said superimposed channels.

5. A combination as defined in claim 1, and including a protecting plate between said conveyor and the profiled member adjacent thereto.

6. A combination as defined in claim 5, and including a super-structure above said profiled members and screw means connecting said super-structure to the protecting plate and said profiled members.

7. A combination as defined in claim 5, and including narrow upright sheet metal strips welded to said protecting plate at the side of the latter facing the profiled member adjacent thereto to reinforce the projecting plate and to form a gap between the latter and said profiled member.

8. A combination as defined in claim 1, wherein the cross-section of each of said superimposed channels is formed by four circular arcs of the same radii having their centers symmetrically offset from the center of the respective channel to opposite sides of vertical and horizontal axes passing through said center of said channel.

9. A combination as defined in claim 8, wherein said chain includes a plurality of guide discs of cylindrical cross-section and connected spaced from each other between said links, the radius of each guide disc being equal to the radii of said circular arcs and larger than the width of said chain links.

10. A combination as defined in claim 1, wherein each of said profiled members has a pair of bow-shaped legs having free end portions forming with the corresponding end portions of the other profiled member a dovetailed guide.

11. A combination as defined in claim 10, wherein the lower ends of said profiled members are located at a level below a bottom face of said conveyor and above the bottom face of said bottom plate.

12. A combination as defined in claim 10, wherein each of said profiled members has between said bow-shaped legs thereof a central portion having a vertical end face abutting against a corresponding end face of the other profiled member.

13. A combination as defined in claim 12, wherein the central portions of said profiled members are formed with bores therethrough and means, including screw means extending through said bores, for connecting said conveyor to said profiled members and the latter to each other.

14. A combination as defined in claim 13, wherein each of said profiled members has to opposite sides of said central portions thereof outwardly projecting portions forming corners on the outer surfaces of said profiled members which abut against parts of said connecting means.

15. A combination as defined in claim 13, and including a super-structure located above said guide channel means, a bar extending transversely through the guide slot of the upper of said two superimposed channels, and additional screw means for clamping said super-structure to said guide channel means and said bar between said profiled members.

16. A combination as defined in claim 13, wherein the profiled member facing away from said conveyor is provided in the region of the axis of said screw means with keyhole-shaped openings into which portions of means for advancing the apparatus towards the mine face are adapted to extend.

17. A combination as defined in claim 1, wherein said end portion of said bottom plate has a free end fixedly attached to said lower run of said endless chain and wherein said elongated cylindrical guide member is fixedly connected to said end portion between said free end and the remainder of said bottom plate, and including an additional guide channel for guiding said elongated cylindrical guide member.

18. A combination as defined in claim 17, and including a plate fixed to the side of the conveyor facing said chain guide means, said plate having a lower portion bent toward the chain guide means and forming a guide track for slidingly guiding said cylindrical guide member.

19. A combination as defined in claim 18, and including a bent sheet metal member between said plate and said chain guide means for covering said guide track.

* * * * *